US010954943B2

(12) United States Patent
Akei

(10) Patent No.: US 10,954,943 B2
(45) Date of Patent: Mar. 23, 2021

(54) COMPRESSOR COMPRISING A VARIABLE VOLUME INDEX VALVE

(71) Applicant: Carrier Corporation, Farmington, CT (US)

(72) Inventor: Masao Akei, Cicero, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 882 days.

(21) Appl. No.: 15/105,229

(22) PCT Filed: Oct. 16, 2014

(86) PCT No.: PCT/US2014/060805

§ 371 (c)(1),
(2) Date: Jun. 16, 2016

(87) PCT Pub. No.: WO2015/094466

PCT Pub. Date: Jun. 25, 2015

(65) Prior Publication Data

US 2016/0319815 A1 Nov. 3, 2016

Related U.S. Application Data

(60) Provisional application No. 61/918,003, filed on Dec. 19, 2013.

(51) Int. Cl.
*F04C 28/26* (2006.01)
*F04C 18/16* (2006.01)
(Continued)

(52) U.S. Cl.
CPC ..... *F04C 28/26* (2013.01); *F04C 18/16* (2013.01); *F04C 28/12* (2013.01); *F04C 28/16* (2013.01); *F04C 29/12* (2013.01); *F04C 2240/30* (2013.01)

(58) Field of Classification Search
CPC ..... F04C 28/26; F04C 28/12; F04C 28/16; F04C 29/12; F04C 18/16; F04C 2240/30;
(Continued)

(56) References Cited

U.S. PATENT DOCUMENTS 4,222,716 A 9/1980 Shaw
5,345,963 A 9/1994 Dietiker
(Continued)

FOREIGN PATENT DOCUMENTS

CN 1369646 A 9/2002
CN 102042226 A 5/2011
(Continued)

OTHER PUBLICATIONS

International Search Report and Written Opinion for Application No. PCT/US2014060805 dated Feb. 20, 2015; 12 pgs.
(Continued)

*Primary Examiner* — Essama Omgba
*Assistant Examiner* — Christopher J Brunjes
(74) *Attorney, Agent, or Firm* — Cantor Colburn LLP

(57) ABSTRACT

A compressor is provided including a housing having a suction inlet and a discharge outlet. A compression mechanism within the housing is configured to receive a vapor at the suction inlet and to provide a compressor vapor to the discharge outlet. A volume index valve is arranged near the discharge outlet. The volume index valve includes a piston positioned within a hollow chamber and configured to move between a closed position and an open position to provide a bypass flow path from an intermediate portion of the compression mechanism to the discharge outlet. The piston is configured to move within the chamber automatically in response to the operating pressure of the vapor within the compressor.

10 Claims, 8 Drawing Sheets

(51) Int. Cl.

| | |
|---|---|
| ***F04C 29/12*** | (2006.01) |
| ***F04C 28/16*** | (2006.01) |
| ***F04C 28/12*** | (2006.01) |

(58) Field of Classification Search
CPC .. F04C 49/03; F04C 49/08; F04C 49/22–246; F04B 49/03; F04B 49/08; F04B 49/22–246
See application file for complete search history.

(56) References Cited

U.S. PATENT DOCUMENTS

| | | | | |
|---|---|---|---|---|
| 5,509,273 | A | 4/1996 | Lakowske et al. | |
| 6,267,562 | B1 | 7/2001 | Hirota | |
| 6,332,757 | B1 | 12/2001 | Kaneko et al. | |
| 6,663,358 | B2 | 12/2003 | Loprete et al. | |
| 6,739,853 | B1 | 5/2004 | Tang et al. | |
| 7,032,675 | B2 | 4/2006 | Steele et al. | |
| 7,153,109 | B2 | 12/2006 | Cho et al. | |
| 7,878,782 | B2 | 2/2011 | Andersen | |
| 2011/0038747 | A1 | 2/2011 | Shoulders | |
| 2012/0227632 | A1 | 9/2012 | Nemit, Jr. et al. | |
| 2012/0282129 | A1* | 11/2012 | Nemit, Jr. | F04C 28/12 418/201.1 |
| 2013/0170601 | A1* | 7/2013 | Varrin, Jr. | G21C 3/3206 376/313 |
| 2013/0216414 | A1* | 8/2013 | Kopko | F04C 18/16 418/1 |
| 2013/0272911 | A1 | 10/2013 | Tang | |

FOREIGN PATENT DOCUMENTS

| | | | | |
|---|---|---|---|---|
| CN | 102777383 | A | | 11/2012 |
| CN | 103097734 | A | | 5/2013 |
| JP | 4001487 | B2 | | 8/2007 |
| JP | 2011080385 | A | * | 4/2011 |
| WO | 2008069789 | A1 | | 6/2008 |
| WO | 2009121151 | A1 | | 10/2009 |
| WO | 2012037229 | A1 | | 3/2012 |

OTHER PUBLICATIONS

Communication pursuant to Article 94(3) EPC dated Jan. 12, 2018 by the European Patent Office for Application No. 14789745.8-1004 (4 pp.).

Communication pursuant to Article 94(3) EPC dated Jul. 10, 2017 by the European Patent Office for Application No. 14789745.8-1616 (4 pp.).

First Office Action dated May 10, 2017 by the State Intellectual Property Office of the People's Republic of China for Application No. 201480069356.9, with English translation (15 pp.).

Mycro-Cold Screw Compressor Packages "V" Series, mycomasia.com, Accessed on May 24, 2018 at http://www.mycomasia.com/products/v-series.html (2 pp.).

Rotary Twin Screw Compressors, Howden Compressors Ltd., 2014, Accessed on May 30, 2018 at https://www.howden.com/Brochures/Rotary%20Twin%20Screw%20Compressor%20Brochure%202014.pdf (12 pp.).

Second Office Action dated Feb. 13, 2018 by the State Intellectual Property Office of the People's Republic of China for Application No. 201480069356.9, with English translation (10 pp.).

* cited by examiner

COMPRESSOR COMPRISING A VARIABLE VOLUME INDEX VALVE

CROSS-REFERENCE TO RELATED APPLICATION

This application claims the benefit of U.S. provisional patent application Ser. No. 61/918,003 filed Dec. 19, 2013, the entire contents of which are incorporated herein by reference.

BACKGROUND OF THE INVENTION

The invention relates generally to compressors and, more particularly, to a valve for varying the volume index of a compressor.

Screw compressors are commonly used in air conditioning and refrigeration applications. In such a compressor, intermeshed male and female lobed rotors or screws are rotated about their axes to pump a working fluid, such as refrigerant, from a low pressure inlet end to a high pressure outlet end. A screw compressor having fixed inlet and discharge ports built into the housing are optimized for a specific set of suction and discharge conditions and pressures. However, the system in which the compressor is connected rarely operates under constant conditions, especially in an air conditioning application. Nighttime, daytime, and seasonal temperatures can affect the volume ratio of the system and the efficiency with which the compressor operates. Volume ratio or volume index Vi is the ratio of the volume of vapor inside the compressor as the suction port closes to the volume of vapor inside the compressor as the discharge port opens. Screw compressors, scroll compressors, and other similar machines generally have a fixed volume index based on the geometry of the compressor.

In a system where the load varies, the amount of heat being rejected in the condenser fluctuates causing the high side pressure to rise or fall, and resulting in a volume index different from the compressor's fixed volume index. To improve efficiency, the pressure inside the compressor should be generally equal to the pressure in the discharge line from the compressor. If the inside pressure exceeds the discharge pressure, over compression of the gas occurs, and if the inside pressure is too low, back flow occurs, both resulting in a system loss. Therefore, the volume index of the compressor should vary to maximize the efficiency of the compressor at non-uniform operating conditions.

BRIEF DESCRIPTION OF THE INVENTION

According to an aspect of the invention, a compressor is provided including a housing having a suction inlet and a discharge outlet. A compression mechanism within the housing is configured to receive a vapor at the suction inlet and to provide a compressor vapor to the discharge outlet. A volume index valve is arranged near the discharge outlet. The volume index valve includes a piston positioned within a hollow chamber and configured to move between a closed position and an open position to provide a bypass flow path from an intermediate portion of the compression mechanism to the discharge outlet. The piston is configured to move within the chamber automatically in response to the operating pressure of the vapor within the compressor.

In addition to one or more of the features described above, or as an alternative, in further embodiments the hollow chamber includes an integrally formed first portion having a first cross-sectional area and a second portion having a second cross-sectional area larger than the first cross-sectional area. The firs portion being positioned adjacent the compression mechanism and the second portion being adjacent the housing.

In addition to one or more of the features described above, or as an alternative, in further embodiments a cover mounted to the housing overlaps an end of the second portion of the hollow chamber.

In addition to one or more of the features described above, or as an alternative, in further embodiments the piston includes a first section and a second section. The first section is arranged within the first portion of the hollow chamber and has a cross-sectional area complementary thereto. The second section is arranged within the second portion of the hollow chamber and has a cross-sectional area substantially complementary thereto.

In addition to one or more of the features described above, or as an alternative, in further embodiments the piston additionally includes a through hole configured to transmit discharge pressure acting on a free end of the piston, into the portion of the chamber between the cover and a second, opposite end of the piston. A flexible mechanism is arranged within a cavity adjacent the through hole. The flexible mechanism is configured to transform between a first position and a second position to control a flow of discharge pressure through the through hole.

In addition to one or more of the features described above, or as an alternative, in further embodiments the flexible mechanism is a bimetal disk configured to transform between a first position and a second position in response to an adjacent temperature.

In addition to one or more of the features described above, or as an alternative, in further embodiments when the flexible mechanism is in the first position, discharge pressure in the portion of the chamber between the cover and the second end of the piston generates a force on the second end of the piston such that the piston is in the closed position.

In addition to one or more of the features described above, or as an alternative, in further embodiments the compressor further includes a suction passage configured to provide pressure communication between the portion of the chamber between the cover and the second end of the piston and the suction inlet In addition to one or more of the features described above, or as an alternative, in further embodiments a bleed hole extends through the second section of the piston and a suction hole extends from adjacent the suction inlet to a portion of the chamber.

In addition to one or more of the features described above, or as an alternative, in further embodiments when the flexible mechanism is in the second position, the discharge pressure in the portion of the chamber between the cover and the second end of the piston bleeds through the suction passage such that a force generated by the discharge pressure on the free end of the piston moves the piston to the open position.

In addition to one or more of the features described above, or as an alternative, in further embodiments the cover includes at least one flange extending into the second portion of the chamber to define a third portion of the chamber having a cross-sectional area smaller than the cross-sectional area of the second portion of the chamber, but larger than the cross-sectional area of the first portion of the chamber.

In addition to one or more of the features described above, or as an alternative, in further embodiments the piston further includes a third section integrally formed with the second section, the third section being generally arranged within the third portion of the chamber and having a cross-sectional area generally equal thereto.

In addition to one or more of the features described above, or as an alternative, in further embodiments the piston further includes a through hole configured to transmit a discharge pressure acting on a free end of the piston, into the portion of the chamber between the cover and a second, opposite end of the piston.

In addition to one or more of the features described above, or as an alternative, in further embodiments a suction pressure hole extends from the suction inlet to the second portion of the chamber. The suction pressure hole is configured to apply a suction pressure on a first exposed surface of the second section of the piston. An intermediate pressure hole extends from a central portion of the compression mechanism to the second portion of the chamber. The intermediate pressure hole is configured to apply an intermediate pressure on a second exposed surface of the second section of the piston.

In addition to one or more of the features described above, or as an alternative, in further embodiments the first exposed surface has a first surface area generally equal to the difference in the cross-sectional area of the second section of the piston and the cross-sectional area of the third section of the piston and the second exposed surface has a second surface area generally equal to the difference in the cross-sectional area of the second section of the piston and the cross-sectional area of the first section of the piston.

In addition to one or more of the features described above, or as an alternative, in further embodiments when the discharge pressure is substantially greater than the suction pressure, the piston is in a closed position.

In addition to one or more of the features described above, or as an alternative, in further embodiments when the discharge pressure and the suction pressure are minimally different, the piston is in an open position.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
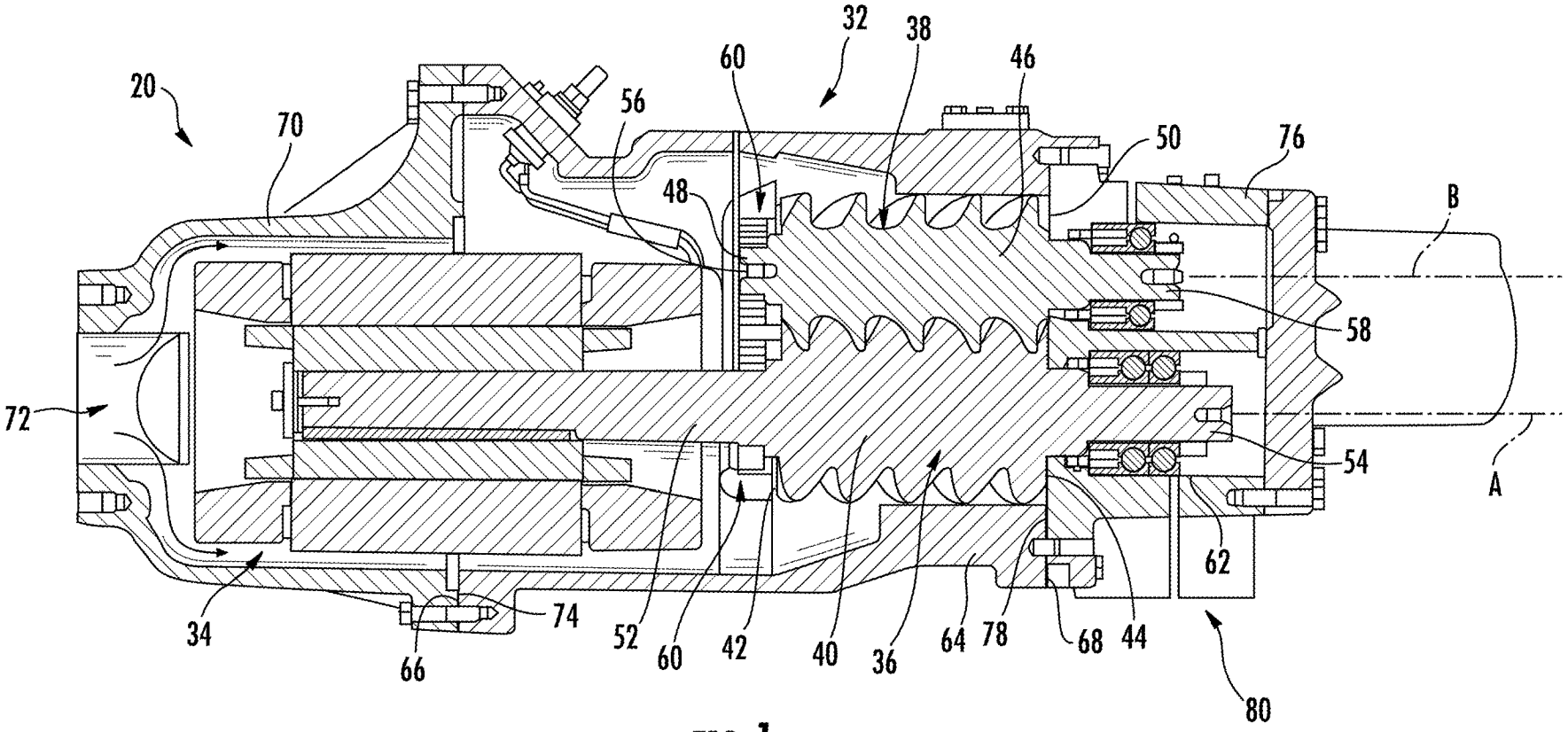
FIG. 1 is a simplified cross-sectional view of a screw compressor showing the discharge end and connections to the discharge line.

Referring now to FIG. 1, an example of a screw compressor 20, commonly used in air conditioning systems, is illustrated in more detail. The screw compressor 20 includes a housing assembly 32 containing a motor 34 and two or more intermeshing screw rotors 36, 38 having respective central longitudinal axes A and B. In the exemplary embodiment, the rotor 36 has a male lobed body 40 extending between a first end 42 and a second end 44. The male lobed body 40 is enmeshed with a female lobed body 46 of the other rotor 38. The female lobed body 46 of the rotor 38 has a first end 48 and a second end 50. Each rotor 36, 38 includes shaft portions 52, 54, 56, 58 extending from the first and second ends 42, 44, 48, 50 of the associated working portion 40, 46. The shaft portions 52 and 56 are mounted to the housing 32 by one or more inlet bearings 60 and the shaft portions 54 and 58 are mounted to the housing 32 by one or more outlet bearings 62 for rotation about the associated rotor axis A, B.

In the exemplary embodiment, the motor 34 and the shaft portion 52 of the rotor 36 may be coupled so that the motor 34 drives that rotor 36 about its axis A, When so driven in an operative first direction, the rotor 36 drives the other rotor 38 in an opposite second direction. The exemplary housing assembly 32 includes a rotor housing 64 having an upstream/inlet end face 66 and a downstream/discharge end face 68 essentially coplanar with the rotor second ends 44 and 50. Although a particular compressor type and configuration is illustrated and described herein, other compressors, such as having three rotors for example, are within the scope of the invention.

The exemplary housing assembly 32 further comprises a motor/inlet housing 70 having a compressor inlet/suction port 72 at an upstream end and having a downstream face 74 mounted to the rotor housing upstream face 66 (e.g., by bolts through both housing pieces). The assembly 32 further includes an outlet/discharge housing 76 having an upstream face 78 mounted to the rotor housing downstream face 68 and having an outlet/discharge port 80. The exemplary rotor housing 64, the motor/inlet housing 70, and outlet housing 76 may each be formed as castings subject to further finish machining. The refrigerant vapor enters into the inlet or suction port 72 with a suction pressure $P_S$ and exits the discharge port 80 of the compressor 20 with a discharge pressure $P_D$, The refrigerant vapor within the compression mechanism of the two or more rotors 36, 38, between the inlet port 72 and the discharge port 80 has an intermediate pressure $P_I$.

Referring now to FIGS. 2-8, a volume index valve 100 is positioned within the rotor housing 64, adjacent the discharge end 44, 50 of the rotors 36, 38. The volume index valve provides a flow path for vapor from an intermediate point of the rotors 36, 38 to the discharge port 80, bypassing the last portion of the compression. The valve 100 moves automatically between a closed position and an open position in response to the operating pressure of the refrigerant vapor within the compressor 20 to control the bypass flow and thus the volume index of the compressor 20.

The volume index valve 100 includes a piston 130 slidably arranged within a hollow chamber 110 formed within the housing assembly 32. The hollow chamber 110 is positioned such that a first end 112 is near the interface between the second rotor ends 44, 50 and the discharge port 80. In one embodiment, an end cap or cover 120 extends over a second end 114 of the chamber 110. The cover 120 may be removably mounted, such as with fasteners 122 for example, to the exterior of the housing 32 to provide easy access to the volume index valve 100. The chamber 110 has a non-uniform cross-section such that a first portion 116 of the chamber 110, extending from the first end 112 has a smaller cross-sectional area than a second portion 118 of the chamber 110, adjacent the housing assembly 32. In one embodiment, shown in FIG. 3, the cover 120 includes at least one flange 124 that extends into the chamber 110 adjacent the second end 114. As a result, the flange(s) 124 define a third portion 126 of the chamber 110, directly adjacent the second end 114, having a cross-sectional area smaller than the second portion 118 of the chamber 110, but larger than the first portion 116.

Figure 2:
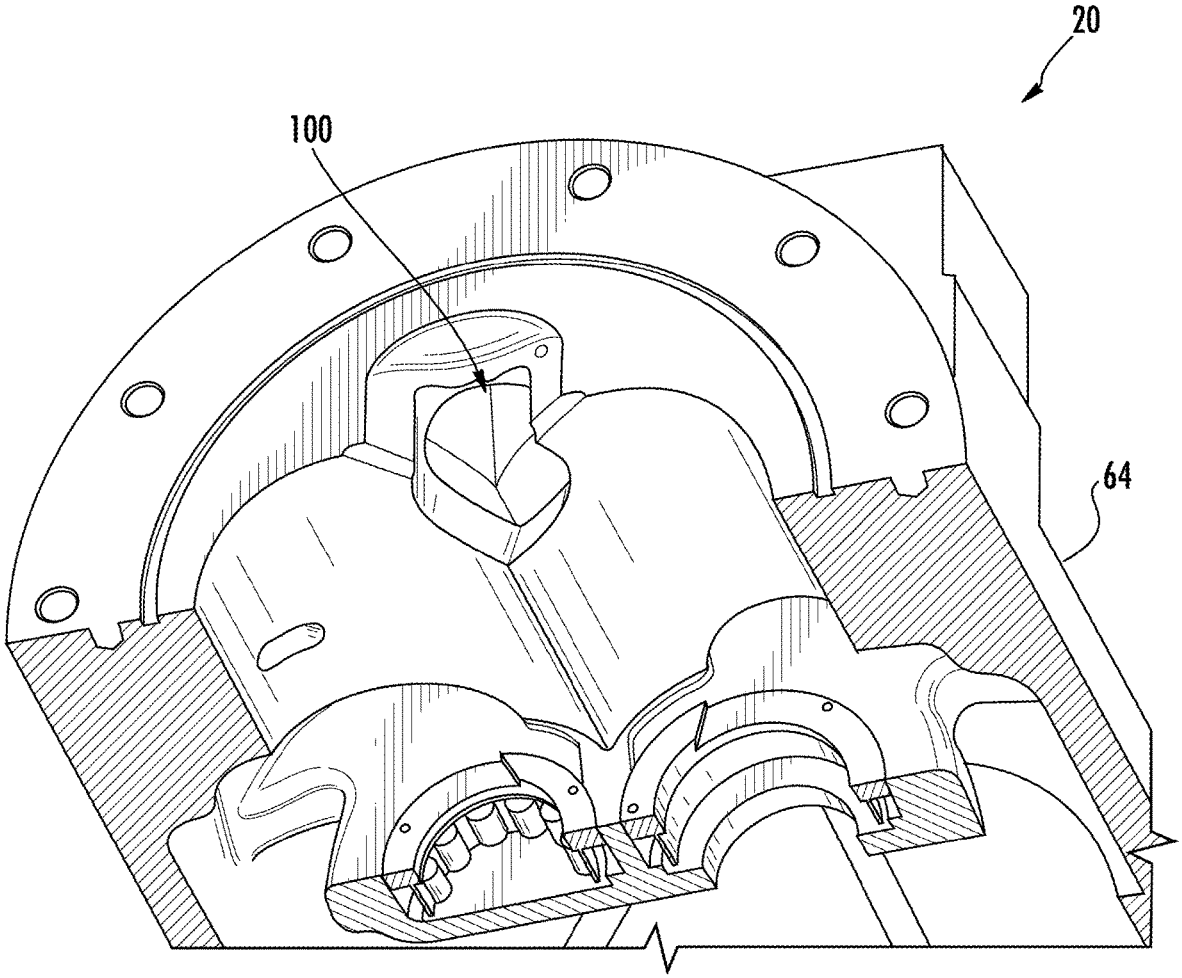
FIG. 2 is a perspective cross-sectional view of a portion of the compressor of FIG. 1 according to an embodiment of the invention.
Figure 3:
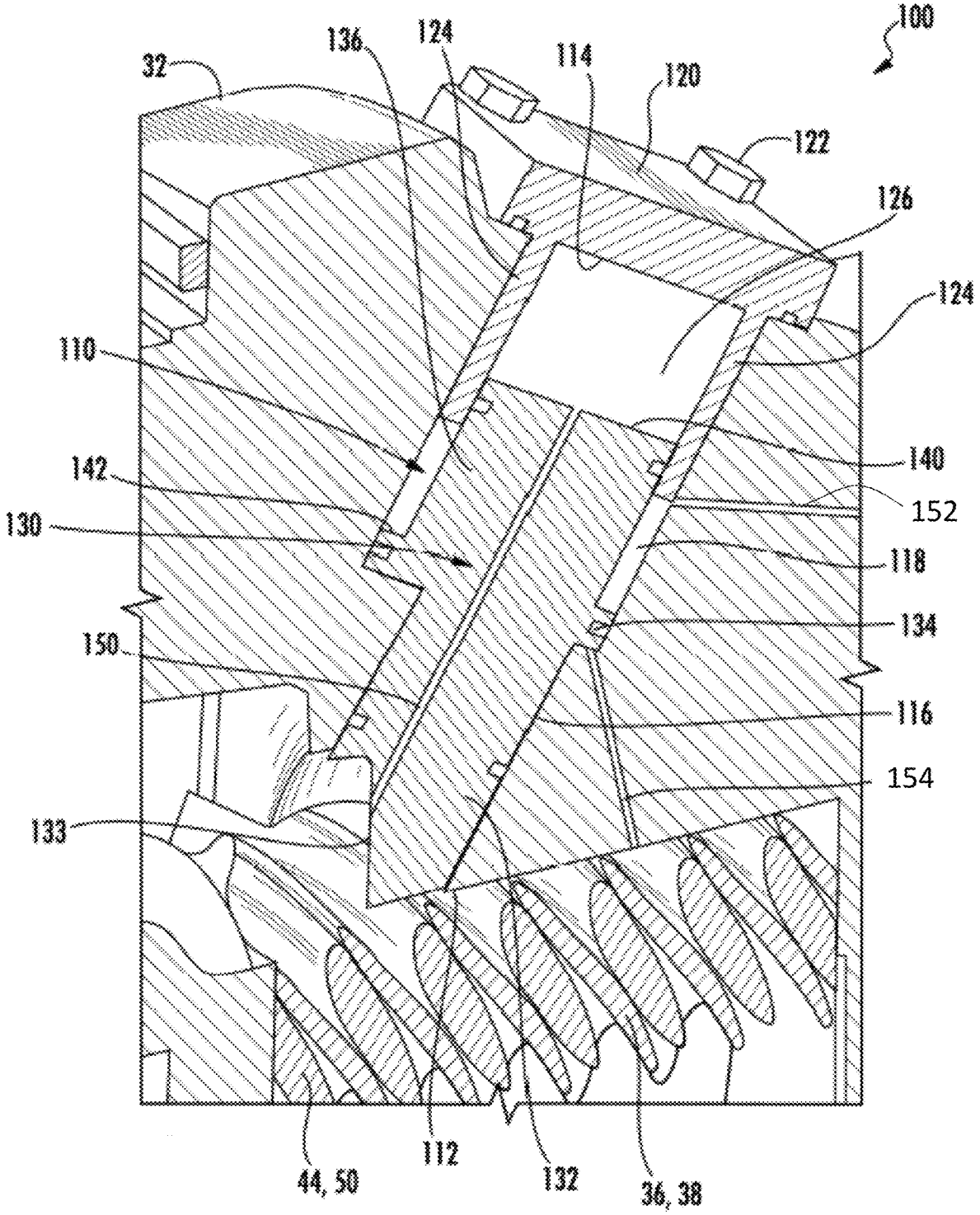
FIG. 3 is a cross-sectional view of a closed volume index valve of a screw compressor according to an embodiment of the invention.
Figure 4:
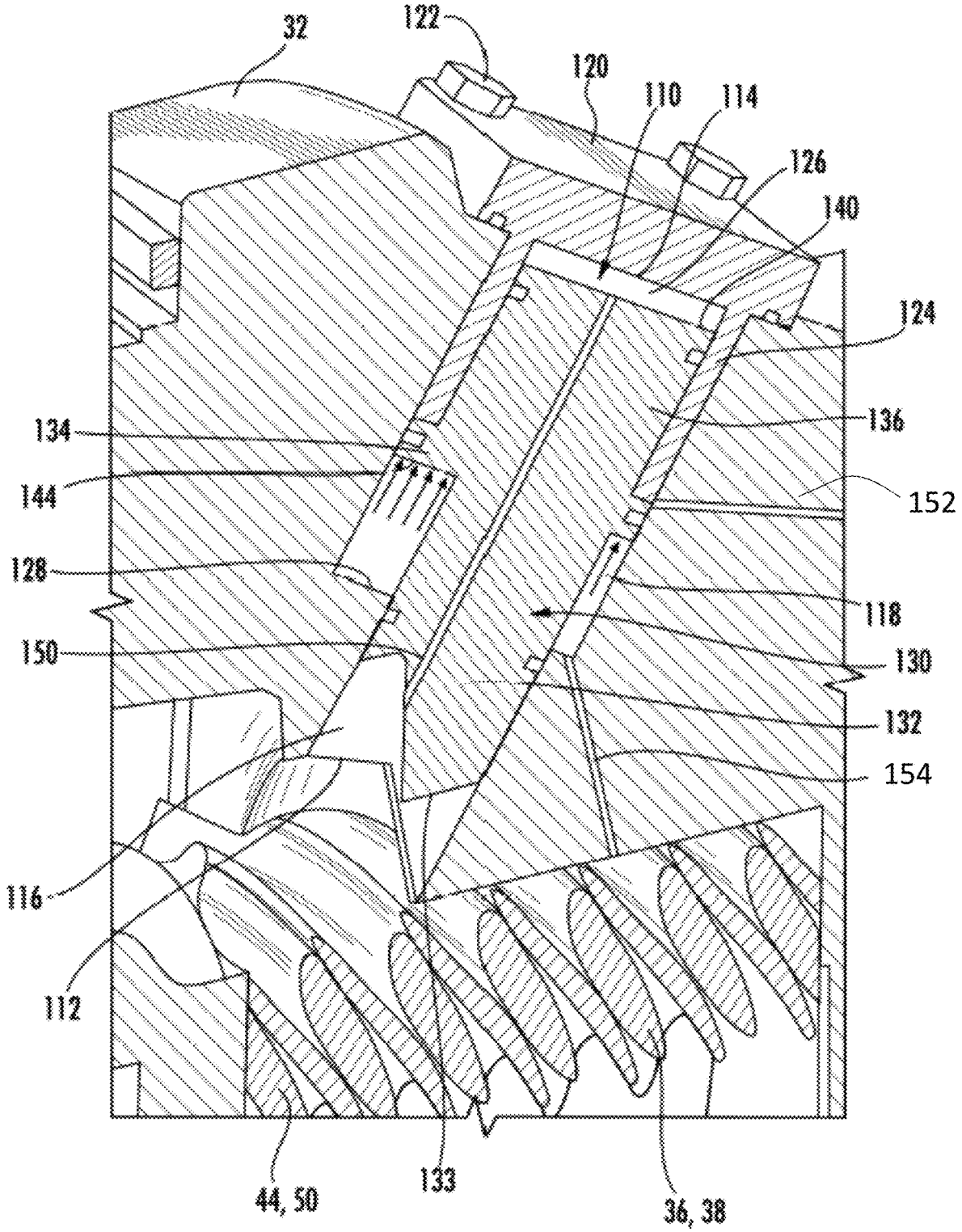
FIG. 4 is a cross-sectional view of an open volume index valve of a screw compressor according to an embodiment of the invention.
Figure 5:
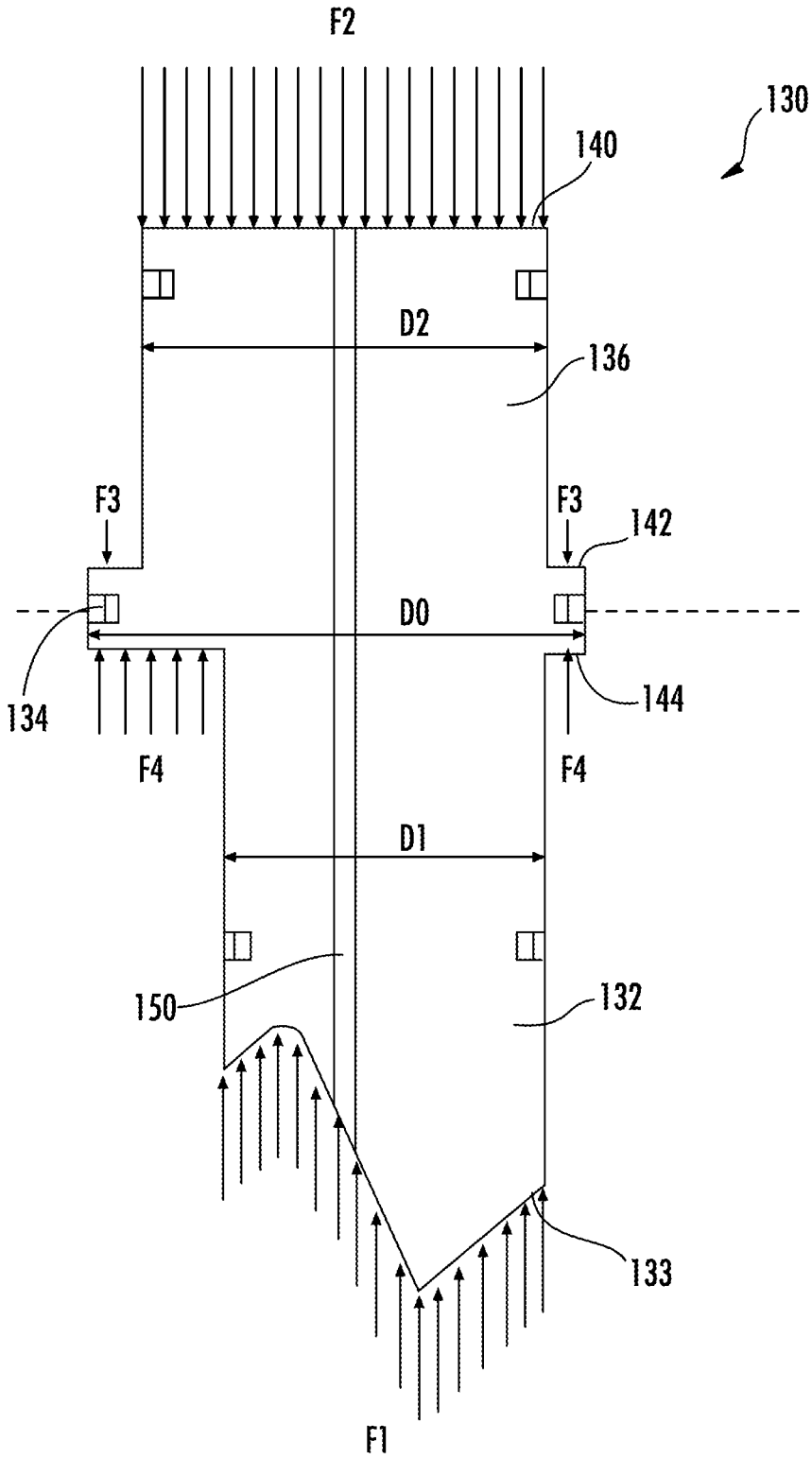
FIG. 5 is a schematic diagram of the forces acting on the piston of the volume index valve according to an embodiment of the invention.

In the embodiment illustrated in FIGS. 2-4, the piston includes a first section 132 arranged within the first portion 116 of the hollow chamber 110 near the rotor ends 44, 50. The first section 132 of the piston 130 has a cross-sectional area generally equal to the cross-sectional area of the first portion 116 of the chamber 110. In the illustrated, non-limiting embodiment, a free end 133 of the first section 132 of the piston 130 is jagged and non-planar. A second section 134 of the piston 130, integrally formed with an end of the first section 132, is arranged within the second portion 118 of the chamber 110 and is configured to contact a wall 128 thereof. The second section 134 of has a cross-sectional area generally equal to the cross-sectional area of the second portion 118 of the chamber 110. A third section 136, integrally formed with an end of the second section 134, is at least partially arranged within the third portion 126 of the chamber 110. The third section 136 has a cross-sectional area generally complementary to the cross-sectional area of the third portion 126 of the chamber 110. The cross-sectional area of the third section 136 is generally larger than the cross-sectional area of the first section 132 and smaller than the cross-sectional area of the second section 134.

A through hole 150 extends from the free end 133 to an opposite end 140 of the piston 130. The discharge pressure $P_D$ acting on the uneven, free end 133 of the piston 130 is communicated via the through hole 150 to the second end 114 of the chamber 110. The discharge pressure $P_D$ applies a force F1 on the first end 133 of the piston 130 equal to the discharge pressure $P_D$ multiplied by the cross-sectional area of the first section 132 of the piston 130. The discharge pressure $P_D$, fills the portion of the chamber 110 between the cover 120 and the piston 130 and applies a force F2 to the opposite end 140 of the piston 130 equal to the discharge pressure $P_D$ multiplied by the cross-sectional area of the third section 136 of the piston 130.

A suction pressure hole 152, formed in the housing 32, extends from the inlet port 72 of the compressor 20 to the second portion 118 of the chamber 110. The suction pressure $P_S$ applies a force F3 to an exposed surface 142 of the second section 134 of the piston 130. The force F3 is equal to the suction pressure $P_S$ multiplied by the surface area of the exposed surface 142. The surface area of the exposed surface 142 is substantially equal to the difference between the cross-sectional area of the second section 134 and the cross-sectional area of the third section 136 of the piston 130. Similarly, an intermediate pressure hole 154 extends through the housing 32 from adjacent a central portion of the rotors 36, 38 to the second portion 118 of the chamber 110. The pressure $P_I$ from the intermediate pressure hole 154 is applied to an opposite exposed surface 144 of the second section 134 of the piston 130. The force F4 generated by the intermediate pressure $P_I$ is equal to the intermediate pressure $P_I$ multiplied by the surface area of the exposed surface 144. The exposed surface 144 has a surface area substantially equal to the difference between the cross-sectional area of first section 132 and the cross-sectional area of the second section 134. The exposed surface 144 over which the intermediate pressure $P_I$ is applied generally has a greater area than the exposed surface 142 over which the suction pressure P is applied.

The piston 130 is configured to slide within the chamber 110 between a closed position (FIG. 3) and an open position (FIG. 4) based on the operating pressure conditions of the compressor 20. When the piston 130 is in the closed position, the surface 144 of the second section 134 is in contact with the wall 128 and the third section 136 is spaced away from the cover 120 by a distance. When the piston 130 is in the open position, the second section 134 of the piston 130 is spaced away from the wall 128 and the third section 136 of the piston 130 is generally adjacent the cover 120. The piston 130 is generally in the closed position when the combination of the force F2 of the discharge pressure $P_D$ on the third section 136 and the force F3 of the suction pressure $P_S$ on the exposed surface 142 of the second section 134 is greater than the combination of the force F1 of the discharge pressure $P_D$ on the first section 132 and the force F4 of the intermediate pressure $P_I$ on the opposite exposed surface 144 of the second section 134. If the combination of the force F1 of the discharge pressure $P_D$ on the first section 132 and the force F4 of the intermediate pressure $P_I$ on the exposed surface 144 of the second section 134 exceeds the combination of the force F2 of the discharge pressure $P_D$ on the third section 136 and the force F3 of the suction pressure $P_S$ on the exposed surface 142 of the second section 134, the piston 130 will move to the open position and allow vapor to flow directly to the discharge port 80.

In general, when the discharge pressure $P_D$) is substantially greater than the suction pressure $P_S$, such as when the ambient temperature is warm for example, the piston 130 will be in the closed position. Similarly, when the discharge pressure $P_D$ is minimally different from the suction pressure $P_S$, such as when the ambient temperature is cool for example, the piston 130 will be in the open position.

Figure 6:
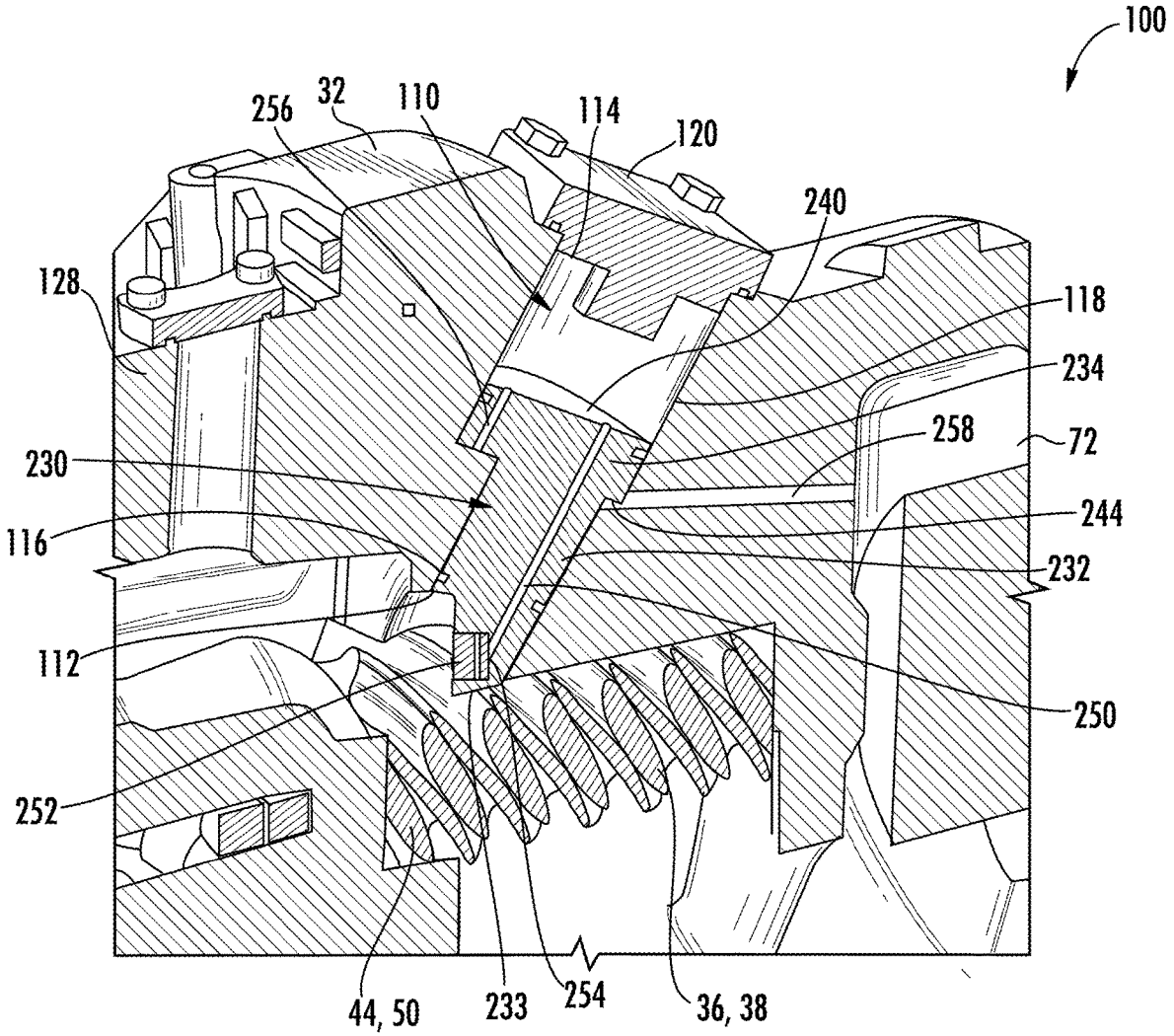
FIG. 6 is a perspective cross-sectional view of a closed volume index valve according to an embodiment of the invention.
Figure 7:
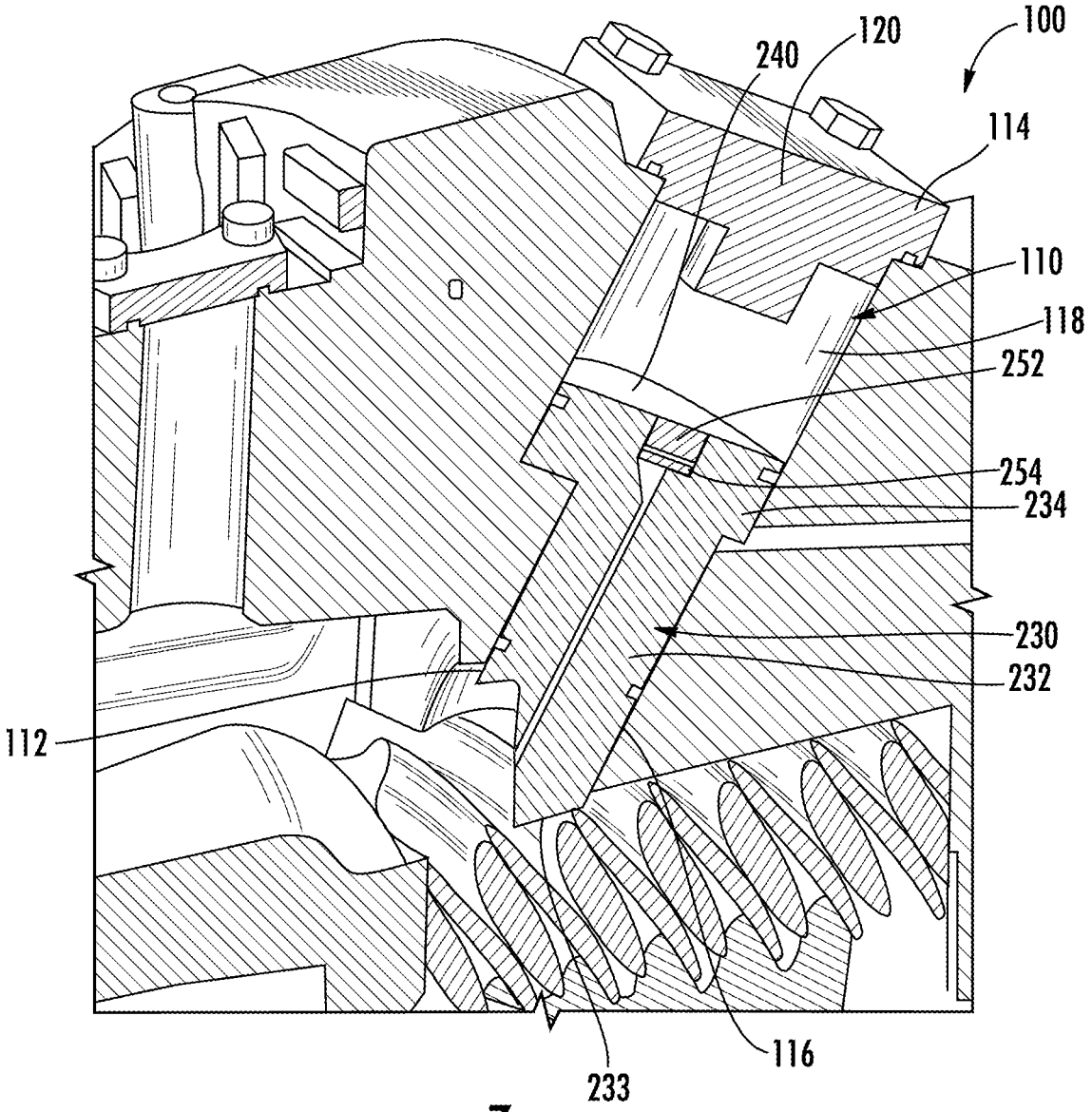
FIG. 7 is a perspective cross-sectional view of a closed volume index valve according to another embodiment of the invention.
Figure 8:
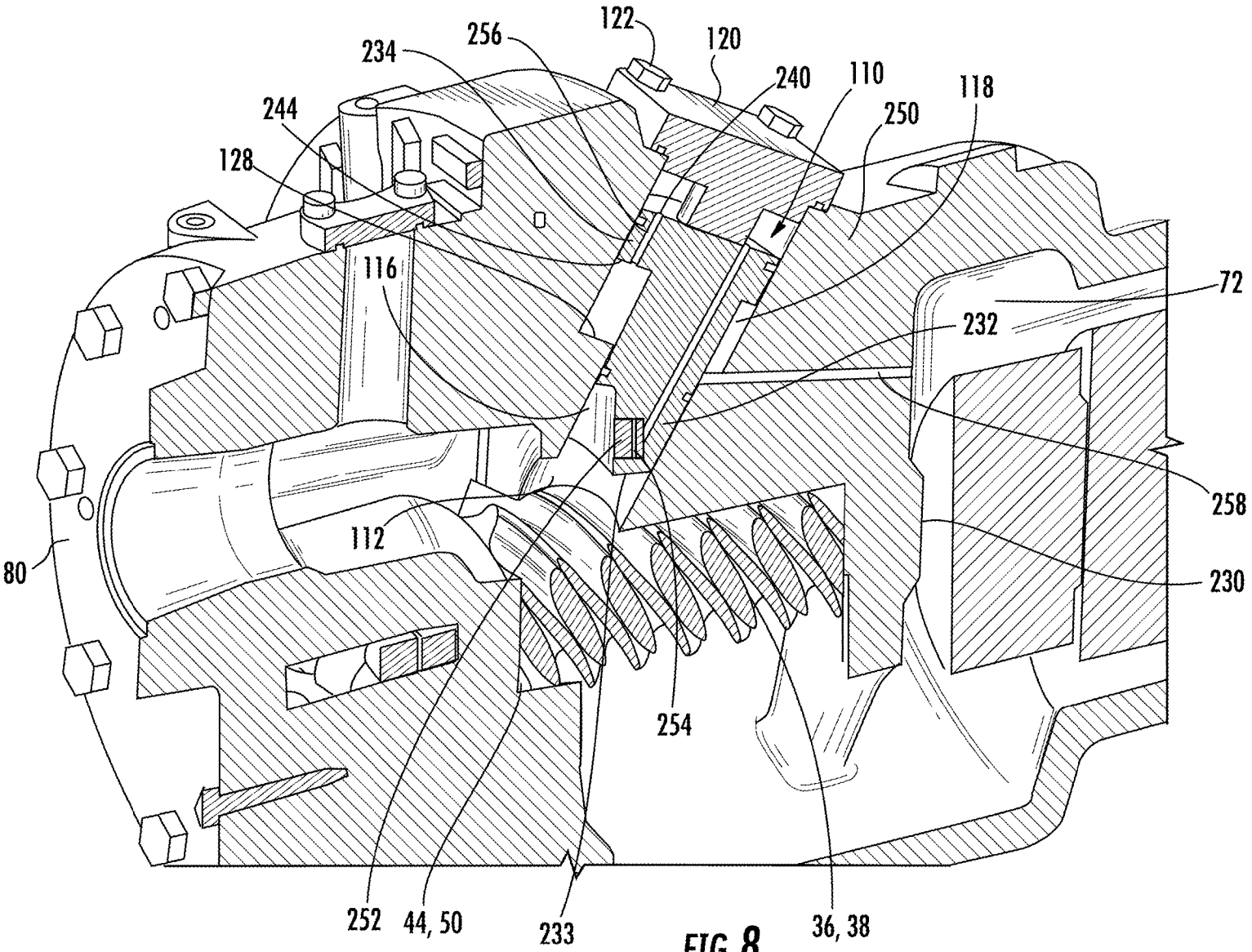
FIG. 8 is a perspective cross-sectional view of an open volume index valve according to an embodiment of the invention.

Referring now to FIGS. 6-8, another piston 230 configured to move between a closed position and an open position within the hollow chamber 110 is illustrated. The piston includes a first section 232 arranged within the first portion 116 of the hollow chamber 110 and a second section 234, extending from the first section, into the second portion 118 of the chamber 110. The second section 234 of the piston 230 has a cross-sectional area generally larger than the first section 232. In the illustrated, non-limiting embodiment, a free end 233 of the first section 232 of the piston 230 is jagged and non-planar. In the closed position, a surface 244 of the second section 234 contacts the wall 128 of the chamber 110 and in the open position, the surface 244 is spaced away from the wall 128 by a distance.

A through hole 250 extends from the free end 233 to an opposite end 240 of the piston 230. A cavity 252 including a flexible mechanism 254 may be formed in the piston 230 adjacent the free end 233, as shown in FIG. 6, or adjacent the opposite end 240, as shown in FIG. 7. A suction passage may be formed to provide a pressure communication between the inlet port 72 of the compressor 20 to the second portion 118 of the chamber. In the embodiment illustrated in FIGS. 6-8, the suction passage is comprised of a bleed hole 256 formed in the second section 234 of the piston 230, extending from the end 240 to the surface 244 of the second section 234, and a suction pressure hole 258, formed in the housing 32, extends from the inlet port 72 of the compressor 20 to the second portion 118 of the chamber 110.

In the illustrated, non-limiting embodiment, the flexible mechanism 254 is a bi-metal disk configured to flex between a first concave position (FIG. 6), and an second convex position in response to a temperature change (FIG. 8). The flexible mechanism 254 is used to control the flow of discharge pressure $P_D$ into the portion of the chamber 110 between the second section 234 of the piston 230 and the cover 120. When the discharge vapor adjacent the second rotor ends 44, 50 has a high temperature, the flexible mechanism 254 flexes to the first concave position, thereby allowing discharge pressure $P_D$ to flow through the through hole 250 and into the chamber 110. The buildup of discharge pressure $P_D$ within the chamber 110 applies a force to the second end 240 of the piston 230 such that the piston 230 remains in the closed position. When the discharge vapor at the second rotor ends 44, 50 has a low temperature, the flexible mechanism 254 flexes to the second, convex position, thereby blocking the flow of discharge pressure into the chamber 110. The discharge pressure $P_D$ will flow through the bleed hole 256 and will equalize pressure in the chamber 110 by releasing pressure via the suction pressure hole 258. As a result, the discharge pressure $P_D$, at the free end 233 of the piston 230 will cause the piston 230 to slide relative to the chamber 110 to an open position.

In general, when the discharge pressure $P_D$, is substantially greater than the suction pressure $P_S$, the discharge vapor adjacent the second rotor ends 44, 50 has a high temperature. Therefore the piston 230 will be in the closed position. Similarly, when the discharge pressure $P_D$ is minimally different from the suction pressure $P_S$, the discharge vapor adjacent the second rotor ends 44, 50 has a low temperature, which will cause the piston 230 to be in the open position.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A compressor comprising:

a housing including a suction inlet and a discharge outlet;

a compression mechanism configured to receive a vapor at the suction inlet and to provide compressed vapor to the discharge outlet;

a hollow chamber formed in a portion of the housing adjacent the discharge outlet; and a volume index valve including a piston positioned within the hollow chamber at an angle to the compression mechanism, the volume index valve being movable between a closed position and an open position, wherein in the open position the volume index valve opens a flow path from an intermediate portion of the compression mechanism to the discharge outlet, the piston being configured to move within the chamber automatically in response to the operating pressures of the vapor within the compressor;

wherein the piston further includes a through hole configured to transmit discharge pressure acting on a free end of the piston, into the portion of the chamber between a cover and a second, opposite end of the piston such that the discharge pressure applies force to both ends of the piston in opposite directions;

wherein the hollow chamber includes an integrally formed first portion having a first cross-sectional area and second portion having a second cross-sectional area larger than the first cross-sectional area, the first portion being positioned adjacent the compression mechanism and the second portion being adjacent the housing, the cover mounted to the housing overlaps an end of the second portion of the hollow chamber;

wherein the piston includes a first section arranged within the first portion of the hollow chamber and having a cross-sectional area complementary thereto, and a second section arranged within the second portion of the hollow chamber and having a cross-sectional area complementary thereto;

wherein the cover includes at least one flange extending into the second portion of the chamber to define a third portion of the chamber, the at least one flange having a radial cross-sectional area smaller than the radial cross-sectional area of the second portion of the chamber, but larger than the radial cross-sectional area of the first portion of the chamber;

wherein the piston further includes a third section integrally formed with the second section, the third section being generally arranged within the third portion of the chamber and having a cross-sectional area equal thereto.

2. The compressor according to claim 1, wherein the piston further includes:

a flexible mechanism arranged within a cavity adjacent the through hole, the flexible mechanism is configured to transform between a first position and a second position to control a flow of discharge pressure through the through hole.

3. The compressor according to claim 2, wherein the flexible mechanism is a bimetal disk configured to transform between a first position and a second position in response to an adjacent temperature.

4. The compressor according to claim 2, wherein when the flexible mechanism is in the first position, discharge pressure in the portion of the chamber between the cover and the second end of the piston generates a force on the second end of the piston such that the piston is in the closed position.

5. The compressor according to claim 4, wherein the compressor further includes a suction passage configured to provide pressure communication between the portion of the chamber between the cover and the second end of the piston and the suction inlet.

6. The compressor according to claim 5, wherein the suction passage comprises:

a bleed hole extending through the second section of the piston; and a suction hole extending from adjacent the suction inlet to a portion of the chamber.

7. The compressor according to claim 5, wherein when the flexible mechanism is in the second position, the discharge pressure in the portion of the chamber between the cover and the second end of the piston bleeds through the suction passage such that a force generated by the discharge pressure on the free end of the piston moves the piston to the open position.

8. The compressor according to claim 1, further comprising:

a suction pressure hole extending from the suction inlet to the second portion of the chamber, the suction pressure hole is configured to apply a suction pressure on a first exposed surface of the second section of the piston; and an intermediate pressure hole extending from a central portion of the compression mechanism to the second portion of the chamber, the intermediate pressure hole is configured to apply an intermediate pressure on a second exposed surface of the second section of the piston.

9. The compressor according to claim 8, wherein when the discharge pressure is greater than the suction pressure, the piston is in a closed position.

10. The compressor according to claim 8, wherein when the discharge pressure and the suction pressure are equal, the piston is in an open position.

* * * * *